US005657770A

United States Patent [19]

Focke

[11] Patent Number: 5,657,770

[45] Date of Patent: Aug. 19, 1997

[54] APPARATUS FOR STORING CIGARETTES OR THE LIKE

[75] Inventor: Heinz Focke, Verden, Germany

[73] Assignee: Focke & Co. (GmbH & Co.), Verden, Germany

[21] Appl. No.: 597,399

[22] Filed: Feb. 8, 1996

[30] Foreign Application Priority Data

Feb. 24, 1995 [DE] Germany ..... 195 06 492.5

[51] Int. Cl.[6] ..... A24C 5/60; A24C 5/32; B65B 19/00

[52] U.S. Cl. ..... 131/282; 131/303; 131/304

[58] Field of Search ..... 131/282, 283, 131/303, 304; 53/127, 148–151

[56] References Cited

FOREIGN PATENT DOCUMENTS 7441178 7/1975 Germany .

4224609 1/1994 Germany .

*Primary Examiner*—Jennifer Bahr

*Attorney, Agent, or Firm*—Sughrue, Mion, Zinn, Macpeak & Seas

[57] ABSTRACT

In order to maintain the quality of cigarettes in a cigarette storage chamber (10), the latter is arranged in a housing (16) which is closed on all sides. Constant climatic conditions which are appropriate for maintaining the quality of the cigarettes are established within the housing. The cigarette storage chamber is located in apparatus for manufacturing and packaging cigarettes between cigarette making machine or filter-attaching machine and a cigarette packaging machine.

7 Claims, 2 Drawing Sheets

APPARATUS FOR STORING CIGARETTES OR THE LIKE

BACKGROUND OF THE INVENTION

The invention relates to an apparatus for producing and packaging cigarettes or similar tobacco products, in the case of which a (cigarette) store for temporarily receiving and discharging cigarettes is arranged between a cigarette-producing machine (cigarette maker) or a filter-attaching machine, on the one hand, and a packaging machine, on the other hand.

Packaging machines for cigarettes are usually assigned cigarette stores for temporarily receiving cigarettes. Said stores have the task of receiving a limited supply of cigarettes in order thus to compensate for fluctuations in the feed of the cigarette, on the one hand, and for the capacity of the packaging machine, on the other hand. Such cigarette stores may be designed in various ways. In practice, use is made, in many cases, of stores in which the cigarettes are received along helically wound conveying paths. An example of such a cigarette store is described in DE 43 02 745.

Depending on the configuration of the store and depending on the operational sequences during the manufacture of the cigarettes and during the packaging of the same, the cigarettes may be stored for different periods of time. There are disadvantages for the quality of the cigarettes if the latter are stored unprotected for a relatively long period of time. In order to maintain the flavour, air humidity and temperature have to be kept as constant as possible within narrow limits.

It is already known to condition climatically the entire manufacturing and packaging hall in order to maintain the quality of cigarettes which are stored over a relatively long period of time. This method involves a comparatively high degree of Outlay since large-volume areas have to be climatically conditioned, along with corresponding technical outlay. In the case of the machines being shut down for relatively long periods of time, for example at the weekend, on holidays, etc., the climatically conditioned atmosphere has to be maintained.

SUMMARY OF THE INVENTION

The invention is concerned with maintaining the quality of the cigarettes in conjunction with the packaging of the same. To be precise, the object of the invention is largely to avoid a reduction in quality while unpackaged cigarettes are stored over a relatively long period of time.

In order to achieve this object, the apparatus according to the invention is characterized in that the cigarette store is arranged in a closed chamber or in a closed housing, and in that the interior of the chamber or of the housing is climatically conditioned at least in terns of temperature and/or air humidity.

The invention takes as its departure point the finding that losses in quality and flavour occur, in particular, in the region of a cigarette store usually assigned to, or arranged upstream of, a packaging machine. The function of the cigarette store requires cigarettes, in some circumstances, to be stored in the store for a relatively long period of time before they are supplied to the packaging process. Arranging the entire store within a closed chamber or a closed housing, in which constant climatic conditions are produced at all times, largely avoids a reduction in quality while the cigarettes are in the store. In accordance with the findings of the invention, it is not necessary for the other areas of the manufacturing and packaging installation to be conditioned climatically, on account of the short period of time over which the cigarettes remain therein. The invention thus ensures, with a very low degree of technical outlay and very low costs, that the cigarettes are kept fresh to the optimum extent.

Details of the configuration of the cigarette store and of the climatically conditioned housing are explained in more detail hereinbelow with reference to an exemplary embodiment represented in the drawings, in which:

DESCRIPTION OF A PREFERRED EMBODIMENT

Figure 1:
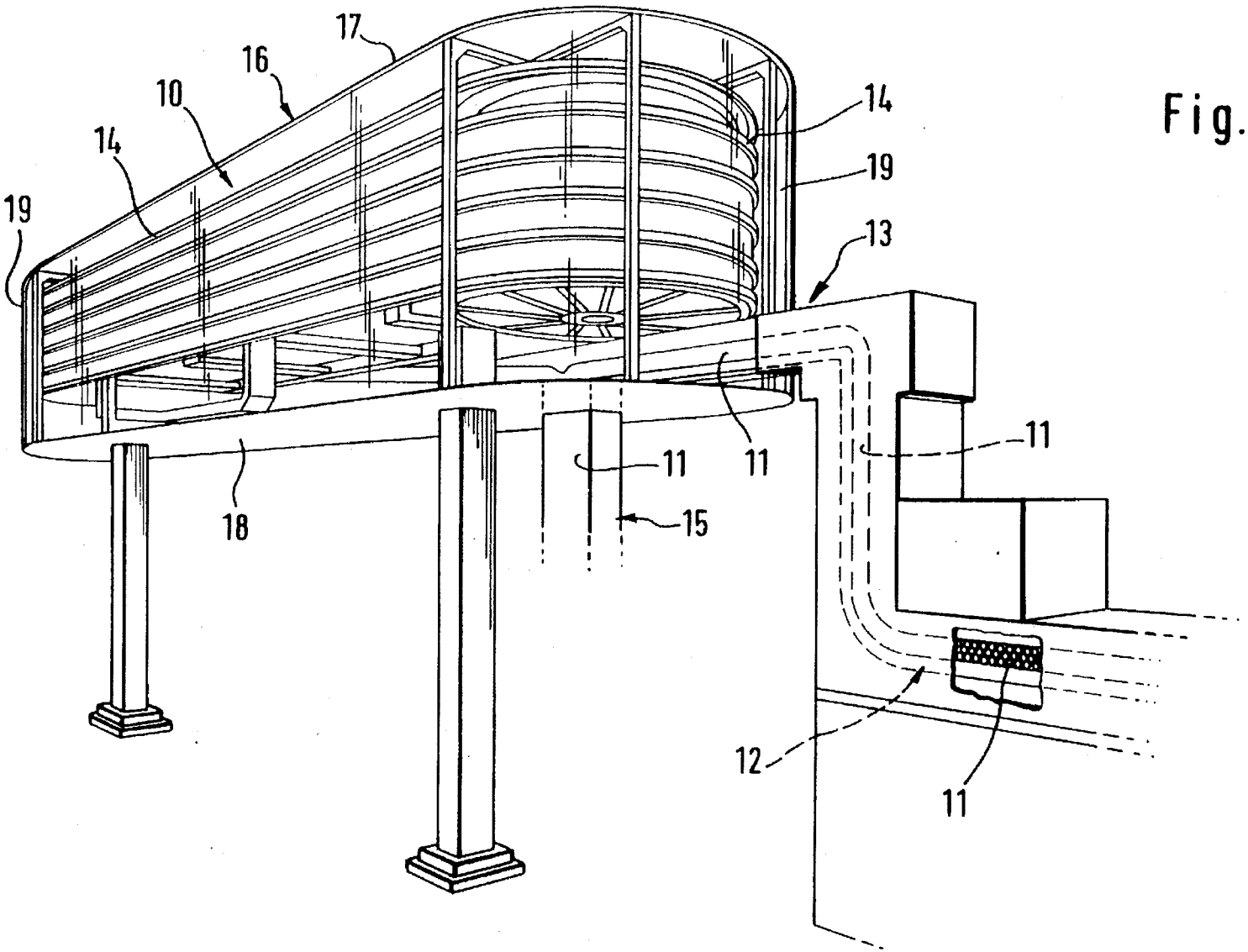
FIG. 1 shows a perspective representation of a cigarette store in a housing.

A cigarette store 10, which may correspond, in terms of construction and mode of operation, to that according to DE 43 02 745, is shown schematically, as an example, in the drawings. Such a cigarette store 10 is usually arranged within a "line" for producing and packaging cigarettes. The cigarette store 10 is normally arranged upstream of the packaging machine (not shown). Cigarettes are fed to the cigarette store 10 from a cigarette-producing machine (maker) or from some other unit, for example a filter-attaching machine.

In the case of the exemplary embodiment shown, a cigarette stream 11 is transported along a conveying path to the cigarette store 10. The conveying path is formed by a feed conveyor 12, which is continuous in cross-section. Said feed conveyor 12 may be designed in the usual manner using conveying belts, for example according to DE 19 57 002.

In the region of a horizontal conveying line 13, the feed conveyor 12 enters, at the bottom, into the cigarette store 10. The conveying line 13 passes into a store conveyor 14, which is wound helically in the present case. In the region of the cigarette store 10, the conveying lines 13 are Joined by a downwardly directed removal conveyor 15 for the cigarettes. The removal conveyor 15 leads the cigarette stream 11 to the packaging machine or, if appropriate, to some other processing machine. The point at which the removal conveyor adjoins the conveying line 13 is designed as a conveying diverter. It is possible for the cigarette stream 11 to pass from the feed conveyor 12 either directly into the removal conveyor 15 or wholly or partially into the cigarette store 10. If required, cigarettes from the cigarette store 10 are fed to the cigarette stream 11 in the removal conveyor 15. For this purpose, the conveying direction of the store conveyor 14 can be reversed.

The cigarette store 10 designed in this manner is arranged, in its entirety, in a housing 16 which is closed on all sides. Said housing comprises a top wall 17, a bottom wall 18 and an encircling side wall 19. The abovementioned walls 17, 18, 19 correspond to the contour of the elongate, oval cigarette store 10. The housing 16 is dimensioned to be only slightly larger than the outer dimensions of the cigarette store 10.

In a bottom region, the feed conveyor 12 leads into the interior of the housing 16 via a corresponding opening in the side wall 19. The removal conveyor 15 leaves the housing 16 in the region of the bottom wall 18. Since feed conveyor 12 and removal conveyor 15 form continuous conveying systems, the casings thereof can enter into the housing 16, and leave the same, via sealed openings. The interior of the housing 16 is thus largely hermetically sealed.

Figure 2:
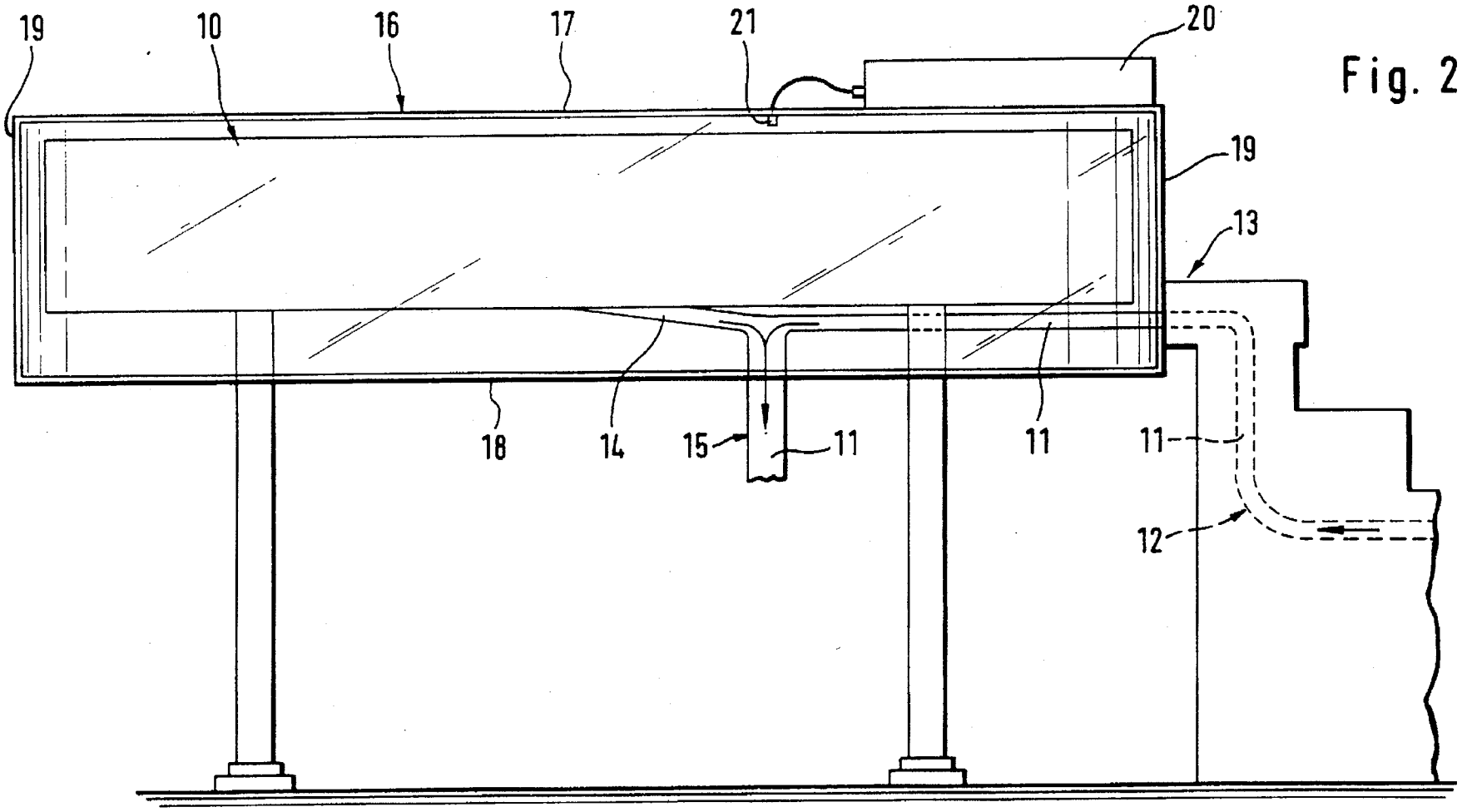
FIG. 2 shows a simplified side view of the apparatus according to FIG. 1.

Constant climatic conditions are produced in the housing 16, and thus in the entire cigarette store 10. In the representation according to FIG. 2, an air-conditioning unit 20 is arranged externally on the top wall 17. Said air-conditioning unit may correspond to the conventional, commercially available design. In the present case, the air-conditioning unit 20 is controlled by at least one sensor 21, which establishes the climatic-condition data within the housing 16.

Relatively precise, constant climatic conditions can be maintained due to the limited dimensions of the housing 16. The air temperature is expediently 21° C. (+/−1° C.). The air humidity is 61% (+/−3%). With these conditions, the usual moisture content of the cigarettes of 10% to 12% is preserved over a long period of time.

The housing 16 may be of a different design. A configuration in which at least sub-regions of the walls 17, 18, 19, but preferably the entire housing 16, consist of transparent material, such as acrylic glass, is advantageous. Furthermore, parts of the walls, in particular sub-regions of the side wall 19, are designed as shutters or doors, so that it is best ensured that there is access to the cigarette store 10 from both sides.

What is claimed:

1. In an apparatus for the production and packaging of cigarettes, in which a cigarette storage means (10) for temporarily receiving and discharging cigarettes is located between a cigarette-producing machine and a packaging machine or between a filter-attaching machine and a packaging machine, the improvement wherein:

a) the cigarette storage means (10) is disposed inside a closed housing (16);

b) the closed housing (16) containing the cigarette storage means (10) is located between the cigarette-producing machine and the packaging machine or between the filter-attaching machine and the packaging machine; and c) there is provided means (20) for climatically conditioning the inside of the housing (16) at least in terms of temperature and/or air humidity.

2. The apparatus according to claim 1, further comprising:

a feed conveyor (12) which is continuous in cross-section, which is adapted to convey a stream (11) of cigarettes, and which leads into the housing (16); and a corresponding, likewise continuous cigarette-removal conveyor (15) leading out of the housing (16).

3. The apparatus according to claim 2, wherein the removal conveyor (15) adjoins the feed conveyor (12) within the housing (16), such that the cigarettes which have been conveyed into the housing by the feed conveyor (12) are transportable alternatively to the cigarette storage means (10) or directly into the removal conveyor (1).

4. The apparatus according to claim 2, wherein the housing (16) has an upright side wall (19) and a bottom wall (18), and wherein the feed conveyor (12) leads into the housing (16) and the conveyor (15) leads out of the housing (16) in a region of said bottom wall (18).

5. The apparatus according to claim 1, wherein said means for conditioning (20) comprises an airconditioning unit (20), outside the housing (16), for monitoring and establishing constant climatic conditions within the housing (16).

6. The apparatus according to claim 1, wherein the housing (16) has at least one wall which is provided with a shutter or a door, or which is designed as a shutter or a door.

7. The apparatus according to claim 3, wherein the housing (16) has an upright side wall (19) and a bottom wall (18), and wherein the feed conveyor (12) leads into the housing (16) and the conveyor (15) leads out of the housing (16) in a region of said bottom wall (18).

* * * * *